US007138953B2

(12) United States Patent
Walker et al.

(10) Patent No.: US 7,138,953 B2
(45) Date of Patent: Nov. 21, 2006

(54) METHOD AND APPARATUS FOR REDUCING THE EFFECTS OF COLLECTOR BLOCKAGE IN A REFLECTOR ANTENNA

(75) Inventors: Joel F. Walker, Malibu, CA (US); Daniel G. Gonzalez, Topanga, CA (US)

(73) Assignee: Malibu Research Associates, Camarillo, CA (US)

( * ) Notice: Subject to any disclaimer, the term of this patent is extended or adjusted under 35 U.S.C. 154(b) by 0 days.

(21) Appl. No.: 11/042,553

(22) Filed: Jan. 25, 2005

(65) Prior Publication Data

US 2005/0168395 A1 Aug. 4, 2005

Related U.S. Application Data

(60) Provisional application No. 60/540,137, filed on Jan. 29, 2004.

(51) Int. Cl.
*H01Q 13/00* (2006.01)

(52) U.S. Cl. ..... 343/781 P; 343/781 CA

(58) Field of Classification Search ..... 343/781 P, 343/781 CA, 781 R
See application file for complete search history.

(56) References Cited

U.S. PATENT DOCUMENTS

| | | | | |
|---|---|---|---|---|
| 4,777,491 | A * | 10/1988 | Bassi et al. | 343/779 |
| 4,905,014 | A | 2/1990 | Gonzalez et al. | 343/909 |
| 5,373,302 | A * | 12/1994 | Wu | 343/781 P |
| 6,198,457 | B1 | 3/2001 | Walker et al. | 343/340 |

* cited by examiner

*Primary Examiner*—Hoang V. Nguyen
(74) *Attorney, Agent, or Firm*—Hoffmann & Baron, LLP

(57) ABSTRACT

A method of reducing blockage in a reflector antenna includes disposing a feed mechanism in front of a first reflector and disposing a second reflector in front of the feed mechanism. The second reflector permits energy to pass that would otherwise have been blocked from being received or transmitted by the first reflector. A reflector antenna is also formed in accordance with this method. Another method of reducing blockage in a reflector antenna includes disposing a first feed mechanism in front of a first reflector and disposing a second antenna in front of the first feed mechanism. The first feed mechanism blocks energy from being received or transmitted by the first reflector. The second antenna receives or transmits energy blocked by the first feed mechanism. A reflector antenna is also formed in accordance with this method.

34 Claims, 20 Drawing Sheets

METHOD AND APPARATUS FOR REDUCING THE EFFECTS OF COLLECTOR BLOCKAGE IN A REFLECTOR ANTENNA

CROSS-REFERENCE TO RELATED APPLICATION

This application claims the benefit of U.S. Provisional Application No. 60/540,137, filed Jan. 29, 2004, which is incorporated herein by reference.

BACKGROUND OF THE INVENTION

1. Field of the Invention

The present invention generally relates to reflector antennas, and more particularly relates to a method and apparatus that reduce the effects of collector surface blockage in reflector antennas while increasing antenna gain and efficiency.

2. Description of the Prior Art

Parabolic antennas have been used for many years as an inexpensive fixed beam antenna in both transmit and receive applications. FIG. 1 shows an example of a center-feed parabolic antenna 10, which has been in common use in backyards as a satellite reception antenna.

Center-feed parabolic antennas 10 work very well in such applications. However, when sidelobe reduction is either desired or required, performance of this type of reflector antenna is limited by blockage of its collector surface 12 by its antenna feed structure 14. This blockage causes discontinuities in the illumination of the parabolic collector surface 12, which are manifested by an increase in undesirable sidelobe levels. FIG. 2 shows an antenna pattern of a parabolic antenna, such as the antenna 10 shown in FIG. 1, in which the sidelobe levels 16 have been increased due to blockage by its feed structure 14.

Therefore, there is an obvious need for a method of reducing the effects of collector surface blockage by feed structures and/or subreflectors in all types of reflector antennas.

OBJECTS AND SUMMARY OF THE INVENTION

It is an object of the present invention to provide a method and apparatus for achieving substantially ideal performance characteristics from a reflector antenna.

It is another object of the present invention to provide a method and apparatus for increasing antenna gain and efficiency, as well as reducing sidelobe levels of a reflector antenna.

It is yet another object of the present invention to provide a method and apparatus for eliminating the effects of collector surface blockage by a feed mechanism or subreflector in a reflector antenna.

A method of reducing blockage in a reflector antenna in accordance with one form of the present invention, which incorporates some of the preferred features, includes disposing at least a portion of a feed mechanism in front of a first reflector and disposing at least a portion of a second reflector in front of the feed mechanism. The feed mechanism is adapted to receive or transmit energy. At least a portion of the second reflector is adapted to permit energy to pass therethrough. The energy passing through the second reflector would otherwise have been blocked from being received or transmitted by the first reflector.

A reflector antenna formed in accordance with another form of the present invention, which incorporates some of the preferred features, includes a first reflector, a feed mechanism, and a second reflector. At least a portion of the feed mechanism is disposed in front of the first reflector and adapted to receive or transmit energy. At least a portion of the second reflector is disposed in front of the feed mechanism. At least a portion of the second reflector is adapted to permit energy to pass therethrough, which would otherwise have been blocked from being received or transmitted by the first reflector.

A method of reducing blockage in a reflector antenna in accordance with yet another form of the present invention, which incorporates some of the preferred features, includes disposing at least a portion of a first feed mechanism in front of a first reflector and disposing at least a portion of a second antenna in front of the first feed mechanism. At least a portion of the first feed mechanism blocks energy from being received or transmitted by the first reflector. The first feed mechanism is adapted to receive or transmit energy. The second antenna is adapted to receive or transmit at least a portion of the energy blocked by the first feed mechanism.

A reflector antenna formed in accordance with still another form of the present invention, which incorporates some of the preferred features, includes a first reflector, a first feed mechanism, and a second antenna. The first reflector is adapted to receive or transmit energy. At least a portion of the first feed mechanism is disposed in front of the first reflector. At least a portion of the first feed mechanism blocks energy from being received or transmitted by the first reflector. The first feed mechanism is adapted to receive or transmit energy. At least a portion of the second antenna is disposed in front of the first feed mechanism, and is adapted to receive or transmit at least a portion of the energy blocked by the first feed mechanism.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 3:
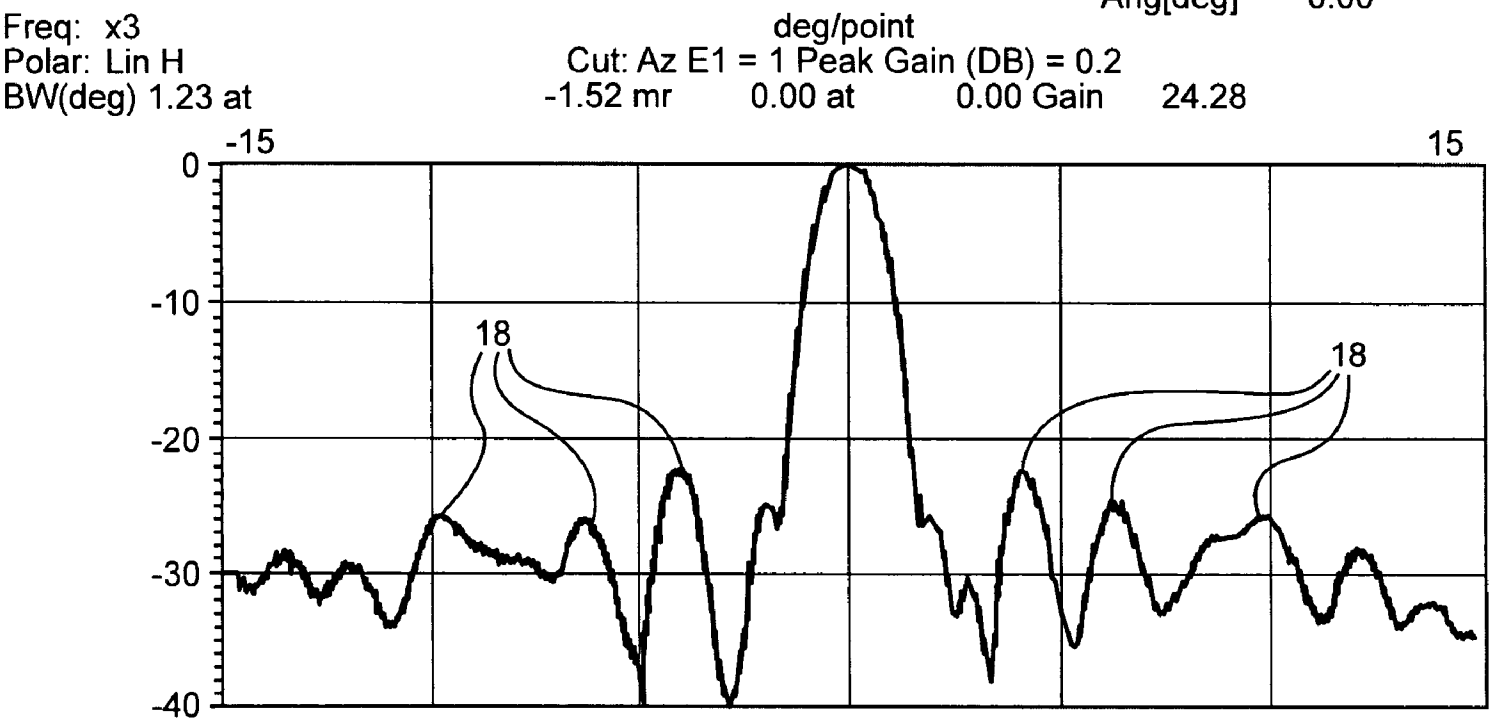
FIG. 3 (Prior Art)
FIG. 3 is an ideal antenna pattern of a parabolic antenna formed in accordance with the present invention, in which blockage of its collector surface by its feed mechanism has been substantially eliminated.

FIG. 3 shows an ideal antenna pattern, which is one goal of a reflector antenna formed in accordance with the present invention, in which blockage of a collector or reflector surface is substantially eliminated. The present invention provides approaches that counteracts the effects of reflector surface blockage, thereby increasing antenna gain and efficiency, as well as reducing sidelobe levels 18, as shown in FIG. 3.

Figure 1:
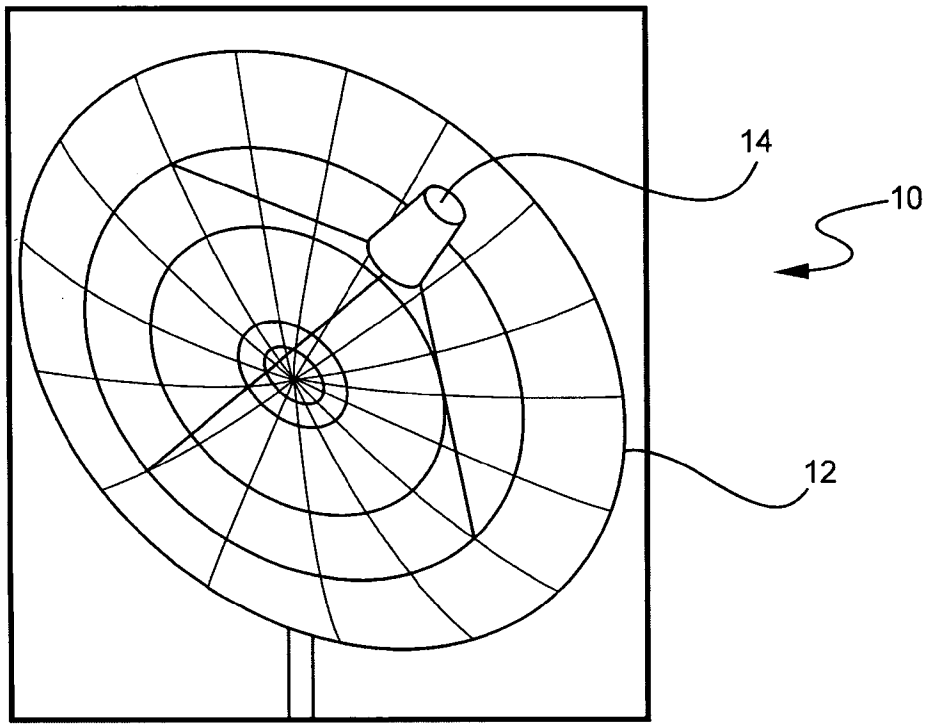
FIG. 1 (Prior Art)
FIG. 1 is conventional parabolic satellite television antenna, which includes a prime focus feed mechanism.
Figure 2:
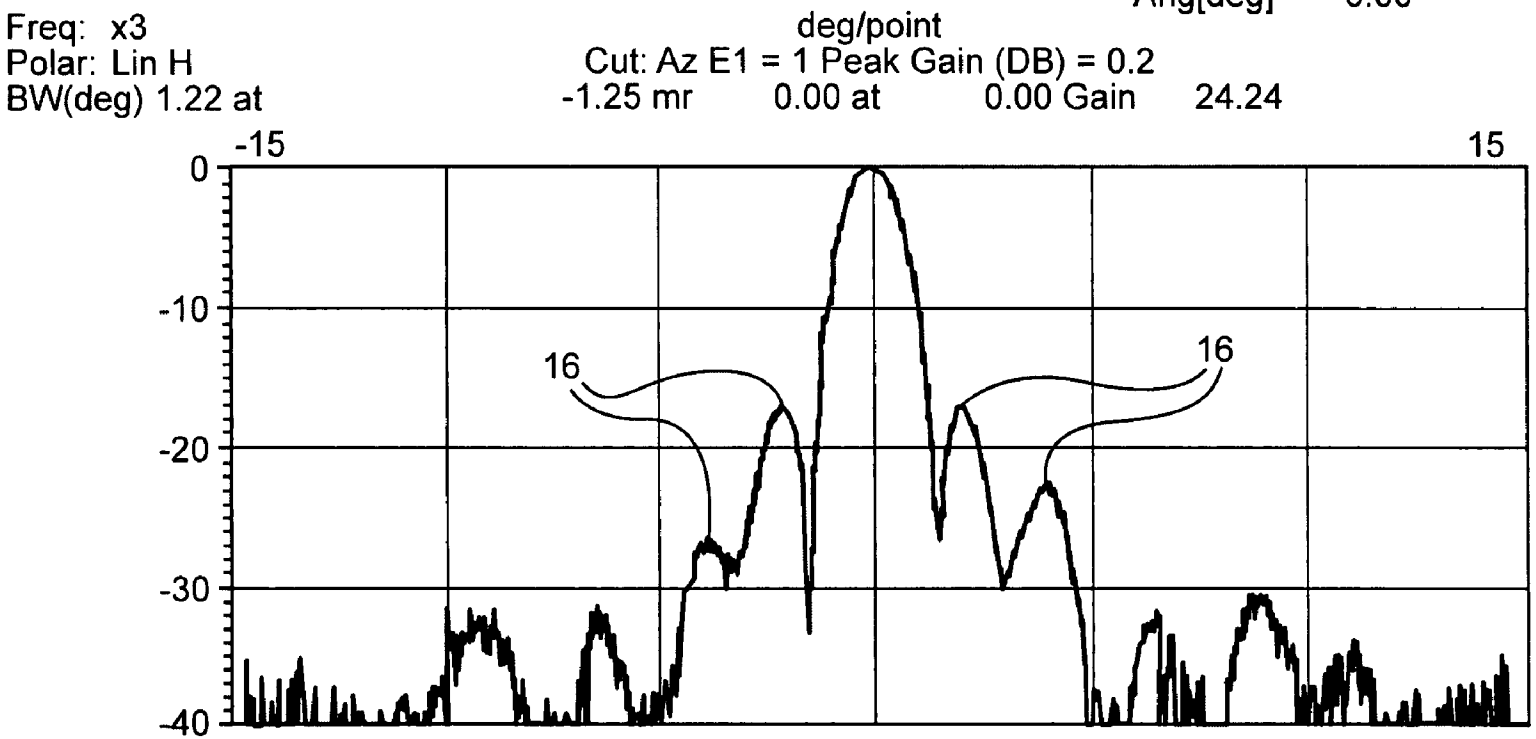
FIG. 2 (Prior Art)
FIG. 2 is an antenna pattern of a parabolic antenna, which exhibits blockage of its collector surface by its feed mechanism.

There are essentially two types of center-feed mechanisms commonly used with reflector antennas. FIG. 1 shows a prime focus feed mechanism 14. This type of feed mechanism is preferably placed at a focal point of a parabolic reflector surface 12. Although the prime focus feed mechanism 14 has a straightforward design, the resulting antenna 10 exhibits inherent disadvantages in terms of increased size, and the need to route signal cables to the feed mechanism 14, both of which affect blockage and cause increased sidelobe levels 16, as shown in the plot of FIG. 2.

Figure 4A:
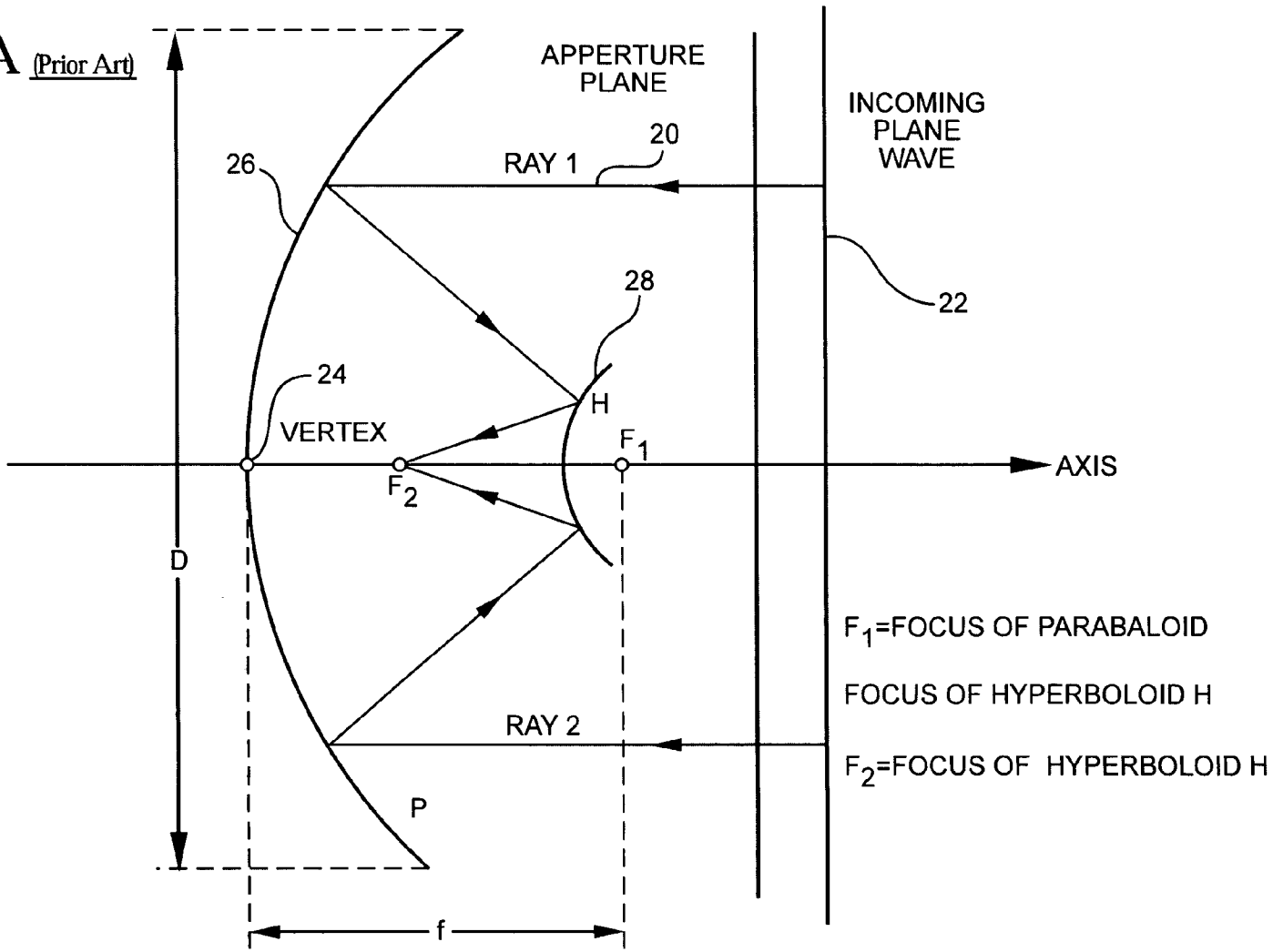
FIG. 4A (Prior Art)
FIG. 4*a* is a conventional parabolic satellite television antenna, which incorporates a cassegrain geometry.
Figure 4B:
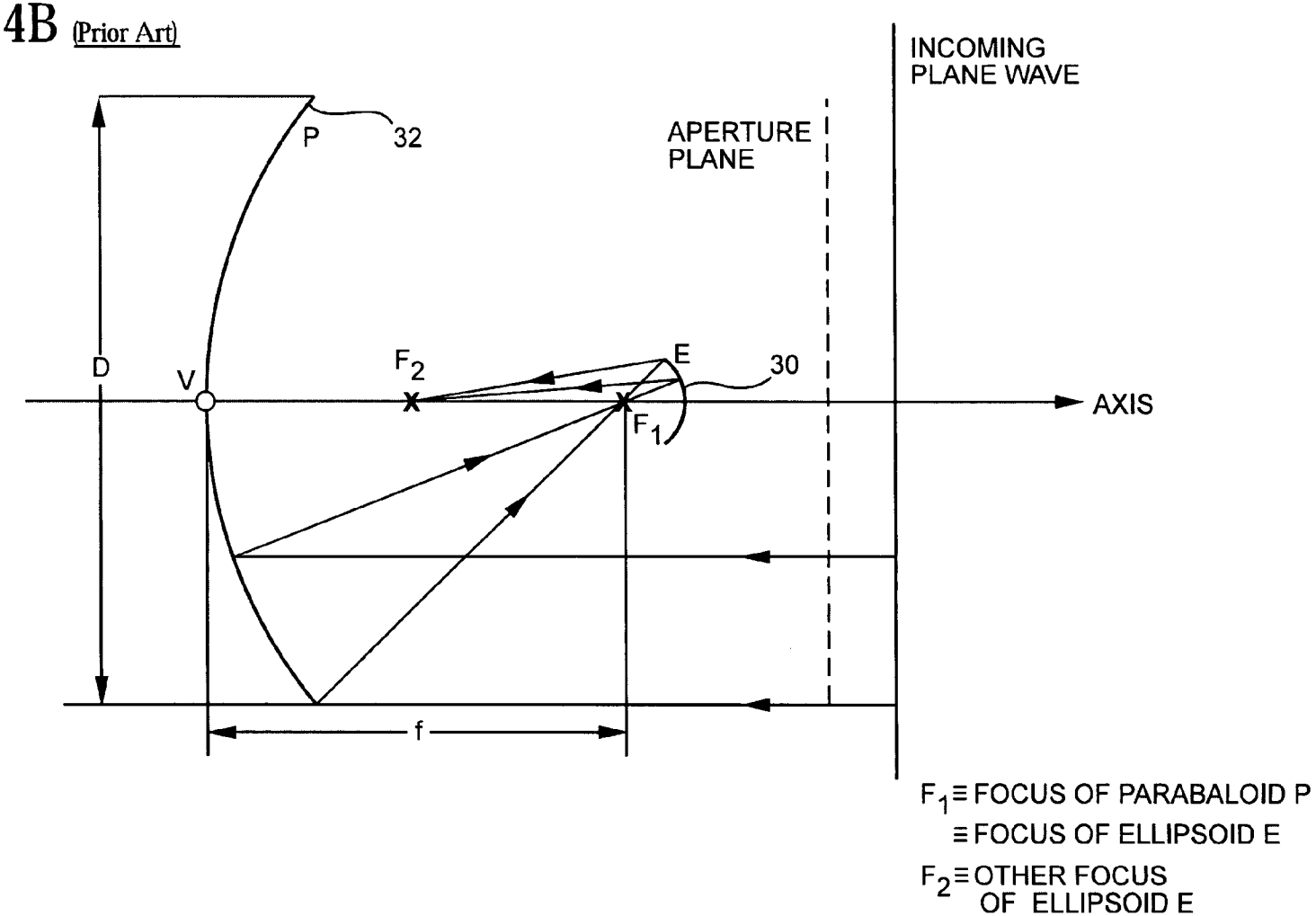
FIG. 4B (Prior Art)
FIG. 4*b* is a conventional parabolic satellite television antenna, which incorporates a gregorian geometry.

FIGS. 4*a* and 4*b* show two additional types of antenna feed mechanism. FIG. 4*a* incorporates a cassegrain geometry and FIG. 4*b* incorporates a gregorian geometry. These types of feed mechanism are preferably placed near the center of the reflector surface and directed substantially upwards to illuminate a subreflector. The subreflector functions to collect energy reflected by the main reflector surface. These types of feed can provide additional form factor options that may result in decreased blockage of the reflector surface. For instance, by reducing the size of the subreflector and/or increasing the size of the main reflector, the percentage of the main reflector that is blocked in relation to the subreflector can effectively be decreased.

As shown in FIG. 4*a*, an incoming ray 20 from an incoming plane wavefront 22 is preferably directed back towards a vertex 24 of a reflector surface 26 when reflected by a subreflector 28, which is represented by a hyperboloid H. The cassegrain system shown in FIG. 4*a* focuses by collocating one focus of the hyperboloid subreflector 28 with a focus of the reflector surface 26 at focus F1. Specifically, the incoming plane wave 22 is reflected from the parabolic reflector 26 and then from the subreflector 28 to finally be focused at focus F2, with is another focus of the hyperboloid subreflector 28. A feed mechanism is preferably located at focus F2 to receive the incident energy.

The gregorian feed geometry shown in FIG. 4*b* includes a subreflector 30 represented by ellipsoid E, which has a near focus F1 collocated with a focus of a main reflector 32 represented by a paraboloid P. A feed is preferably located at F2, which is another focus of the ellipsoid subreflector 30, to receive the energy from the subreflector 30.

For the types of feed mechanism shown in FIGS. 1, 4*a*, and 4*b*, sidelobe performance of the center-feed reflector antenna is limited by a so-called "shadow". This shadow is caused by the feed mechanism, in the prime focus feed antenna shown in FIG. 1, or the subreflector, in the cassegrain and gregorian geometry-based antennas shown in FIGS. 4*a* and 4*b*. The present invention substantially eliminates the effects of this shadow.

Figure 5:
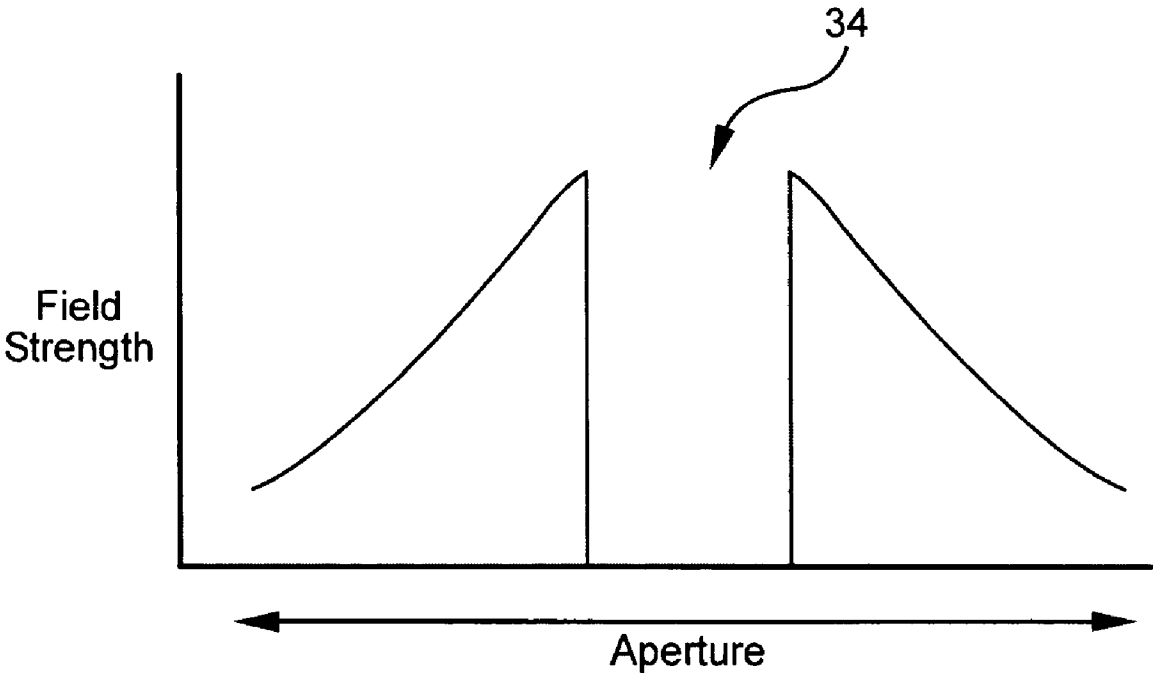
FIG. 5 (Prior Art)
FIG. 5 is a plot of antenna field strength as a function of antenna aperture for a conventional reflector antenna that exhibits blockage of its collector surface by its feed mechanism.

FIG. 5 shows a plot of antenna field strength as a function of antenna aperture. This plot illustrates the effects of blockage on the illumination of a reflector surface and provides a basis for the method and apparatus formed in accordance with the present invention. A central portion 34 of the plot represents the attenuation in field strength caused by the shadow.

Figure 6A:
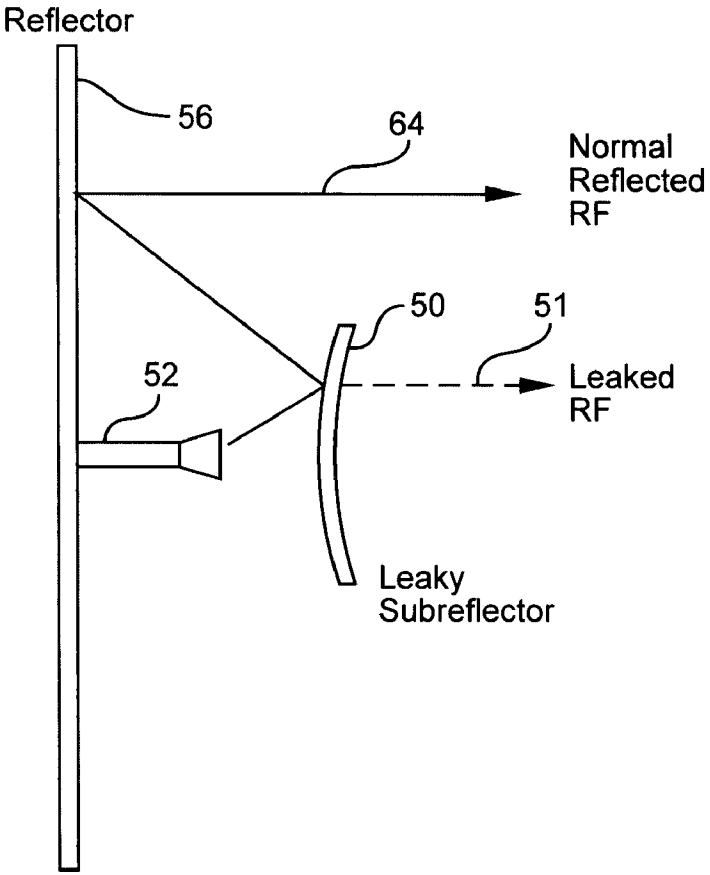
FIG. 6*a* is an embodiment of the present invention in which energy is allowed to pass through a leaky subreflector to mitigate the effects of collector surface blockage.
Figure 6B:
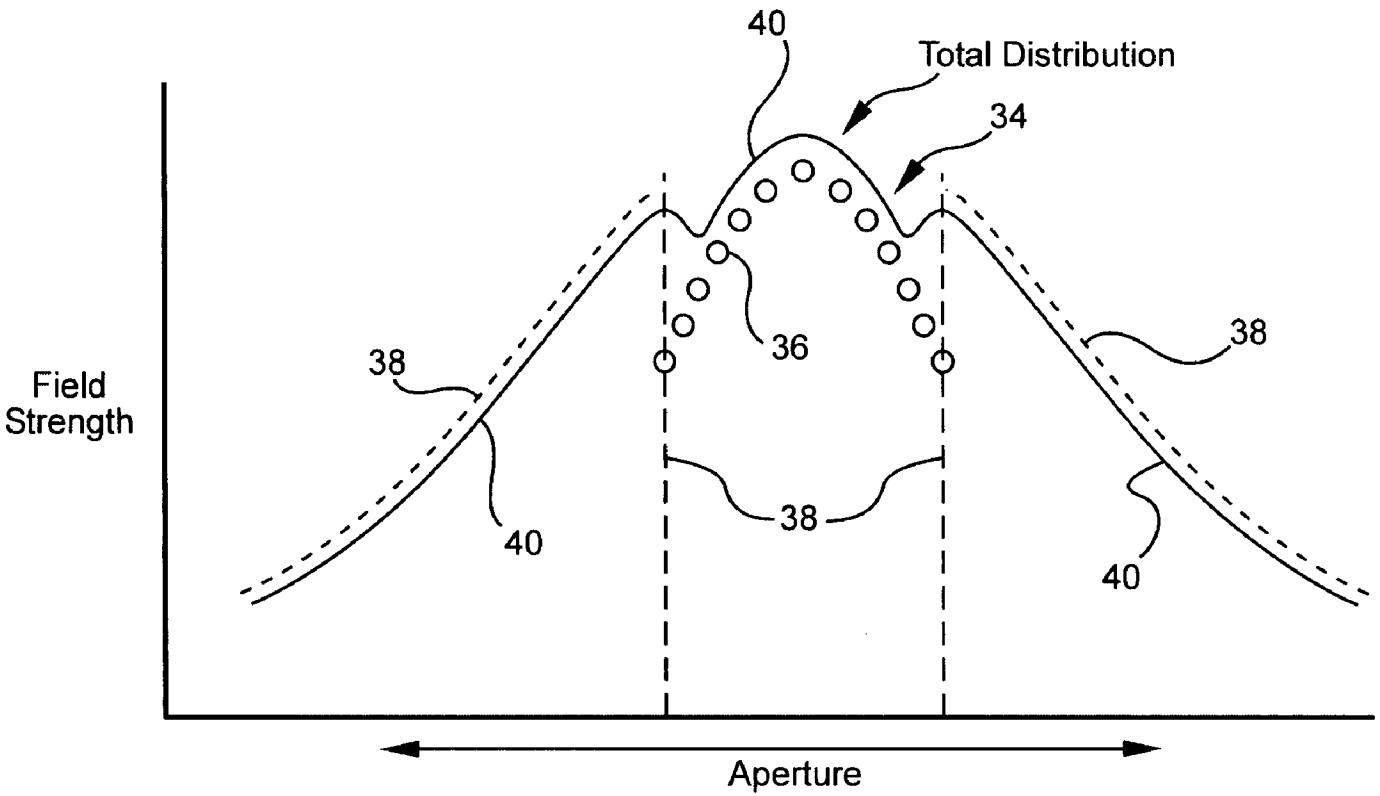
FIG. 6*b* is a plot of antenna field strength as a function of antenna aperture, in which a shadow caused by feed mechanism blockage has been filled in by leaked energy in accordance with the present invention.

FIG. 6*a* shows one solution in accordance with the present invention to the effects of blockage shown in FIG. 5, in which a leaky subreflector 50 enables a portion of the blocked energy to pass as leaked energy 51. FIG. 6*b* is a plot of antenna field strength as a function of aperture for the reflector antenna shown in FIG. 6*a*. The central portion 34 of the plot, which represents attenuation by the shadow, has been filled in by the leaked energy 51 shown in FIG. 6*a*, which is represented by a dotted line 36 in FIG. 6*b*, in accordance with the present invention.

Thus, the resulting plot 40 in FIG. 6*b* incorporates the contribution of leaked energy represented by the dotted line 36, while the plot in FIG. 5 is shown by a dashed line 38 in FIG. 6*b*. By comparing plot 40 with dashed line 38 it becomes clear that the reflector antenna formed in accordance with the present invention substantially increases field strength and significantly decreases the sidelobe levels of conventional reflector antennas. One of the goals of the present invention is to achieve the ideal performance represented in FIGS. 3 and 6*b* by eliminating the effects of collector surface blockage.

Figure 7:
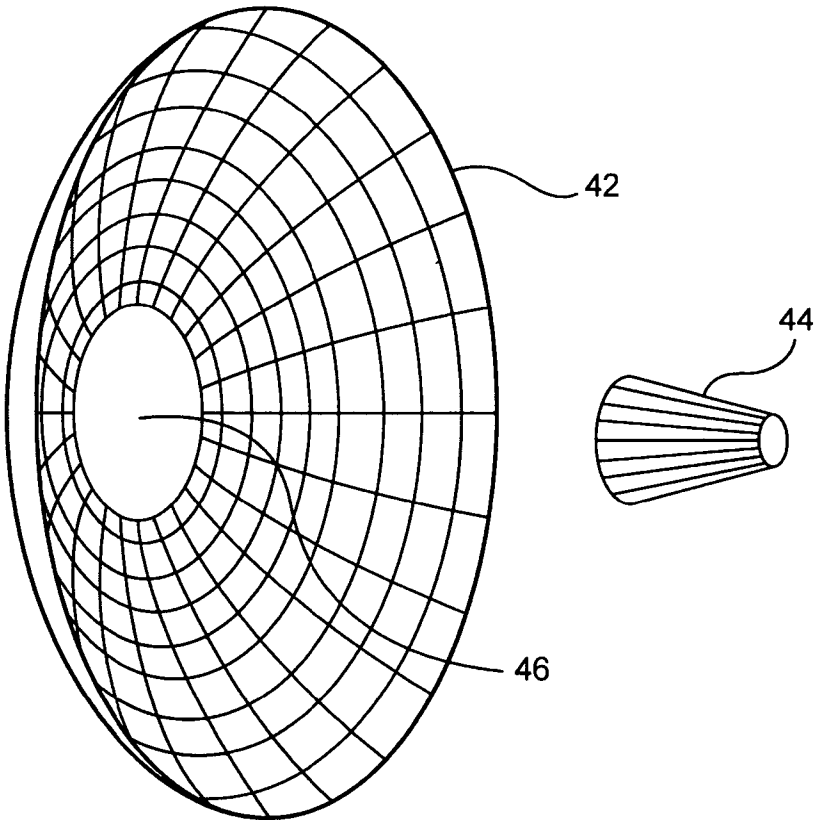
FIG. 7 (Prior Art)
FIG. 7 is a pictorial representation of a conventional parabolic collector surface having a prime focus feed mechanism, which shows a shadow caused by blockage from the feed mechanism.

FIG. 7 is a pictorial representation of a collector surface 42 and a prime focus feed mechanism 44. Blockage by the feed mechanism 44 is shown as a shadow 46 on a central portion of the collector surface 42. The method and apparatus formed in accordance with the present invention essentially collect energy, which is represented by the shadow 46, and electrically add this energy to signals actually captured by the feed mechanism 44, thereby eliminating the effects of the shadow 46.

Figure 8:
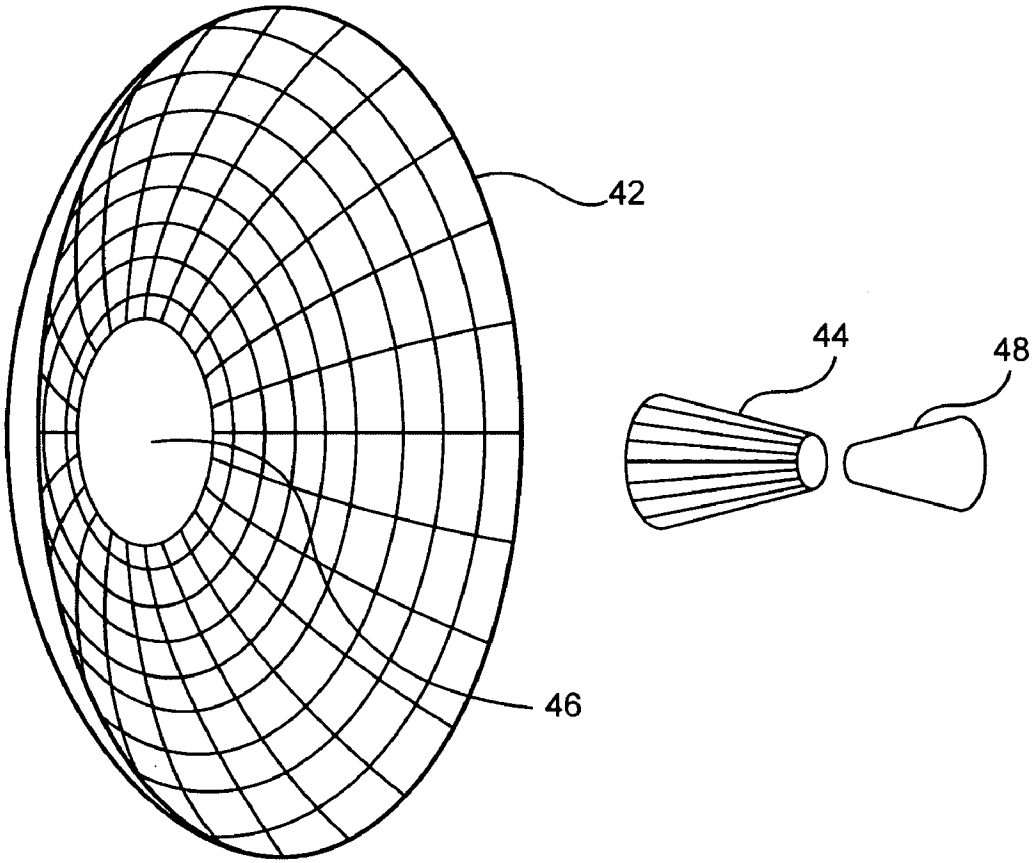
FIG. 8 is a pictorial representation of a secondary antenna used to reduce feed mechanism blockage in accordance with the present invention.

FIG. 8 is a pictorial representation of a secondary antenna 48 that is preferably used to reduce or eliminate the effects of the shadow on the collector surface 42 caused by feed mechanism blockage. The secondary antenna 48 is preferably placed in front of the feed mechanism 44 and has an electronic size substantially the same as the shadow 46 on the collector surface 46.

Two preferred embodiments of the present invention will now be described. Both of these embodiments may be implemented with a parabolic collector surface (FIGS. 9*a*, 10*a*, 10*d*), a Flat Parabolic Surface (FLAPS) collector (FIGS. 9*b*, 10*b*, 10*e*) disclosed in U.S. Pat. Nos. 4,905,014 to Gonzalez et al. and 6,198,457 to Walker et al., which are incorporated herein by reference, or any other collector surface known in the art (FIGS. 9*c*, 10*c*, 10*f*).

Figure 9A:
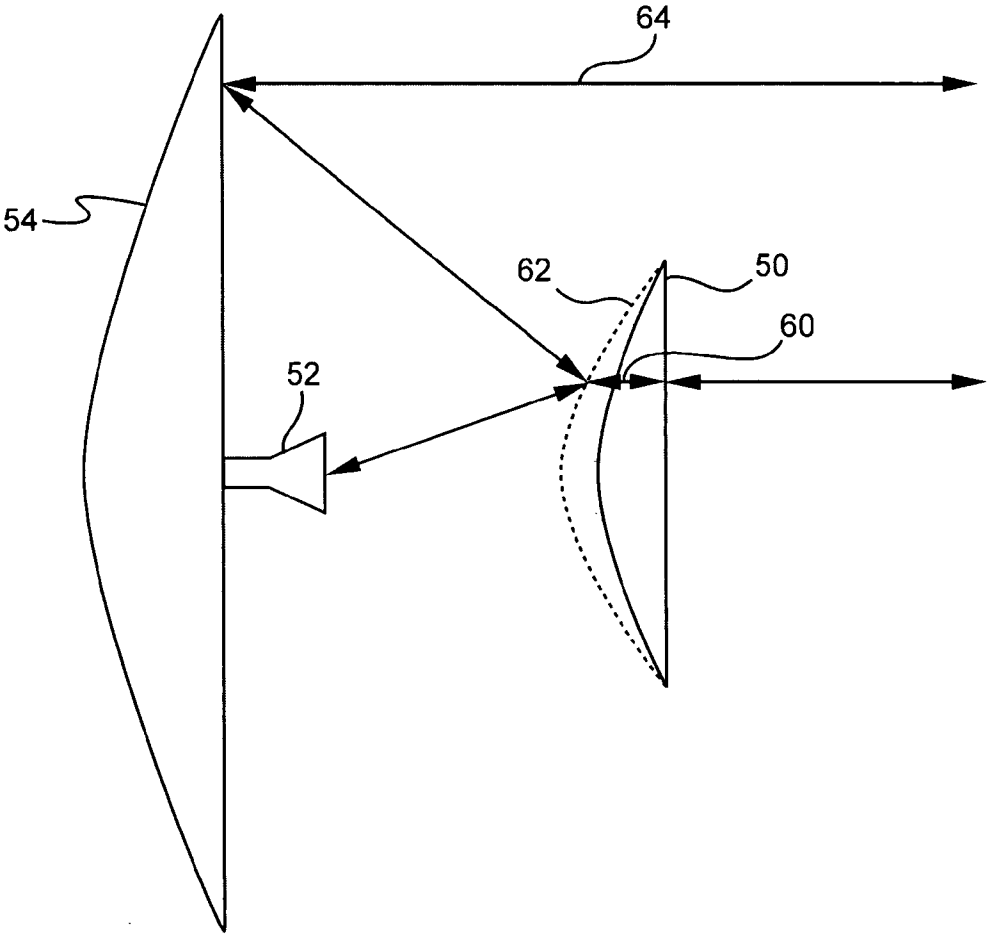
FIG. 9*a* is a first embodiment of the present invention applied to a parabolic collector surface.
Figure 9B:
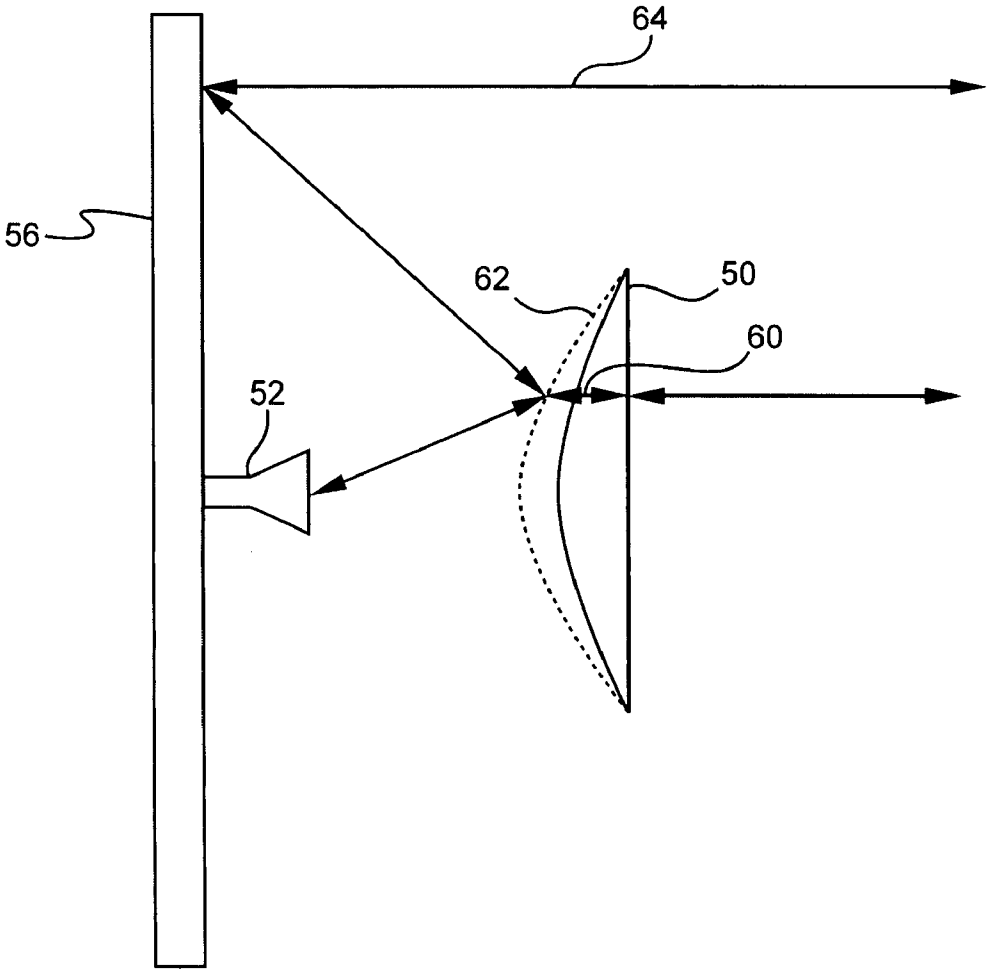
FIG. 9*b* is the first embodiment of the present invention applied to a FLAPS collector.
Figure 9C:
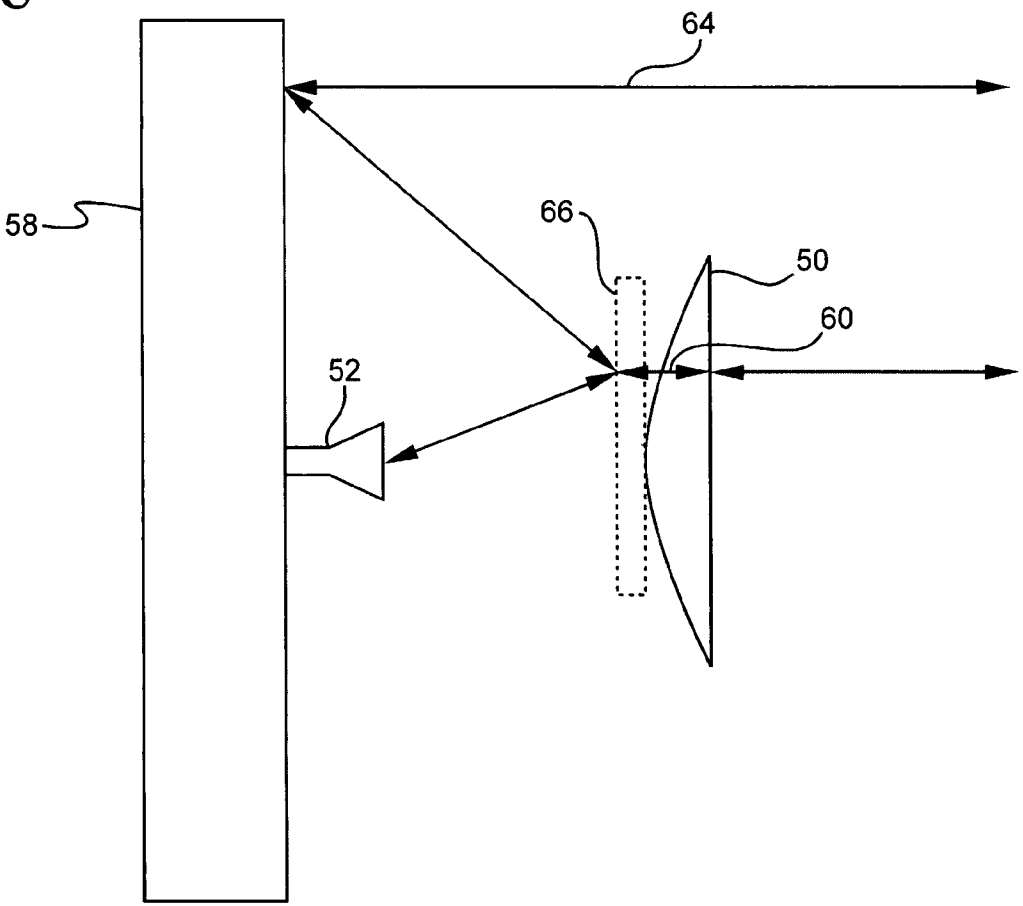
FIG. 9*c* is the first embodiment of the present invention applied to a generic collector surface.

A first embodiment shown in FIGS. 9*a*, 9*b*, and 9*c*, which is preferably applied to cassegrain or gregorian geometry-based reflector antennas, utilizes energy that passes through an electrically porous or leaky subreflector 50 in order to mitigate the shadow caused by the feed mechanism 52 on a main reflector 54. FIG. 9*a* shows the first embodiment applied to a parabolic collector surface 54, FIG. 9*b* shows the first embodiment applied to a FLAPS collector surface 56, and FIG. 9*c* shows the first embodiment applied to a collector surface 58 known in the art. Energy 60 that flows through the leaky subreflector 50, may be directionally adjusted, as well as adjusted in phase and amplitude so that it may be appropriately combined with energy 64 from the main collector surface 54, 56, 58, thereby eliminating the effects of collector surface blockage.

Direction, amplitude, and phase adjustments are preferably implemented by a lens 62, shaped aperture, or any structure known in the art 66, such as a dielectric coating, as shown in FIGS. 9*a*, 9*b*, and 9*c*, respectively. The shape of the lens 62, aperture, or structure 66 may limit use of the first embodiment to applications within a preferred bandwidth, such as 10% of the full bandwidth of the antenna system.

As described above, the shadow 46 shown in FIGS. 7 and 8 appears on the main collector surface 42 due to blockage by the feed mechanism 44. This shadow 44 is also manifested as a smaller secondary shadow (not shown) on the subreflector of a cassegrain or gregorian geometry-based reflector antenna. The second embodiment of the present invention preferably provides a signal that substantially eliminates the effects of the secondary shadow on the subreflector of cassegrain or gregorian geometry antennas, which thereby eliminates the corresponding shadow on the main collector surface.

Figure 10A:
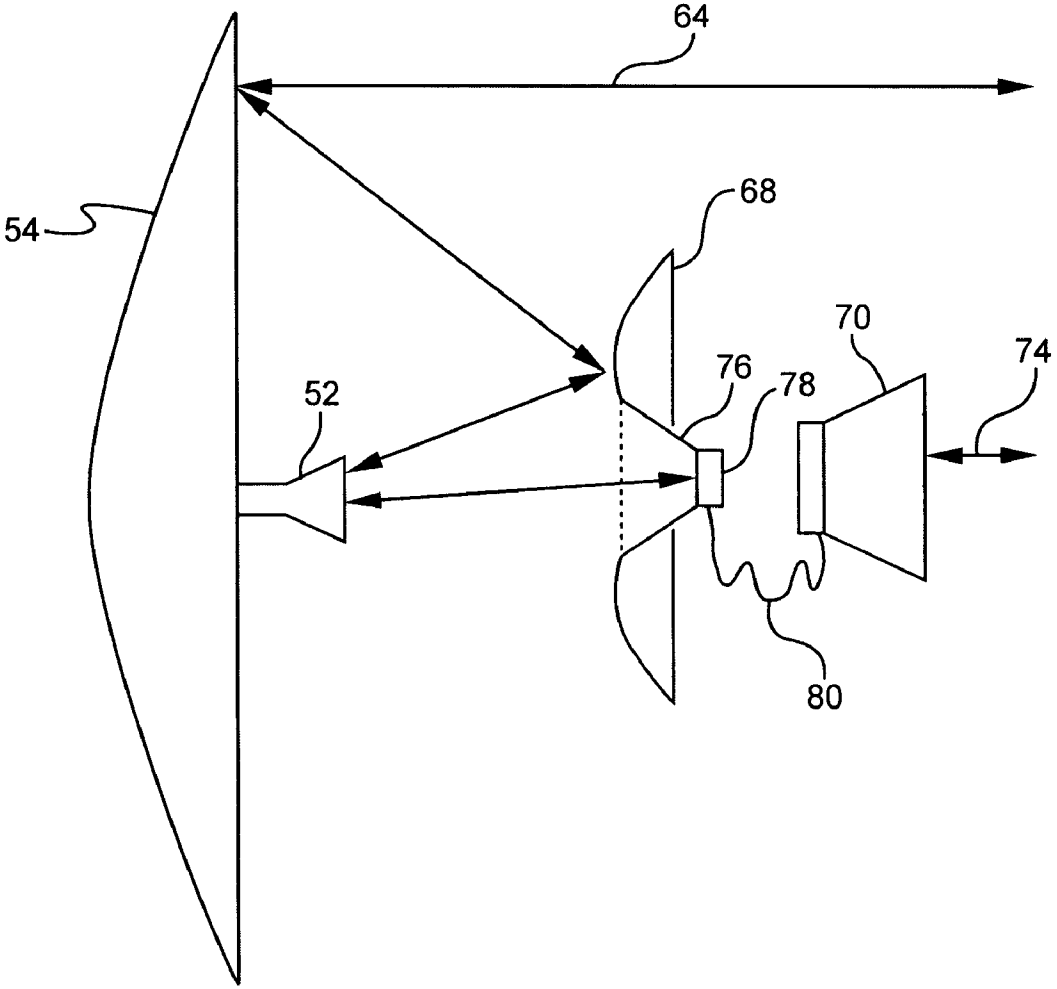
FIG. 10*a* is a second embodiment of the present invention applied to a parabolic collector surface.
Figure 10B:
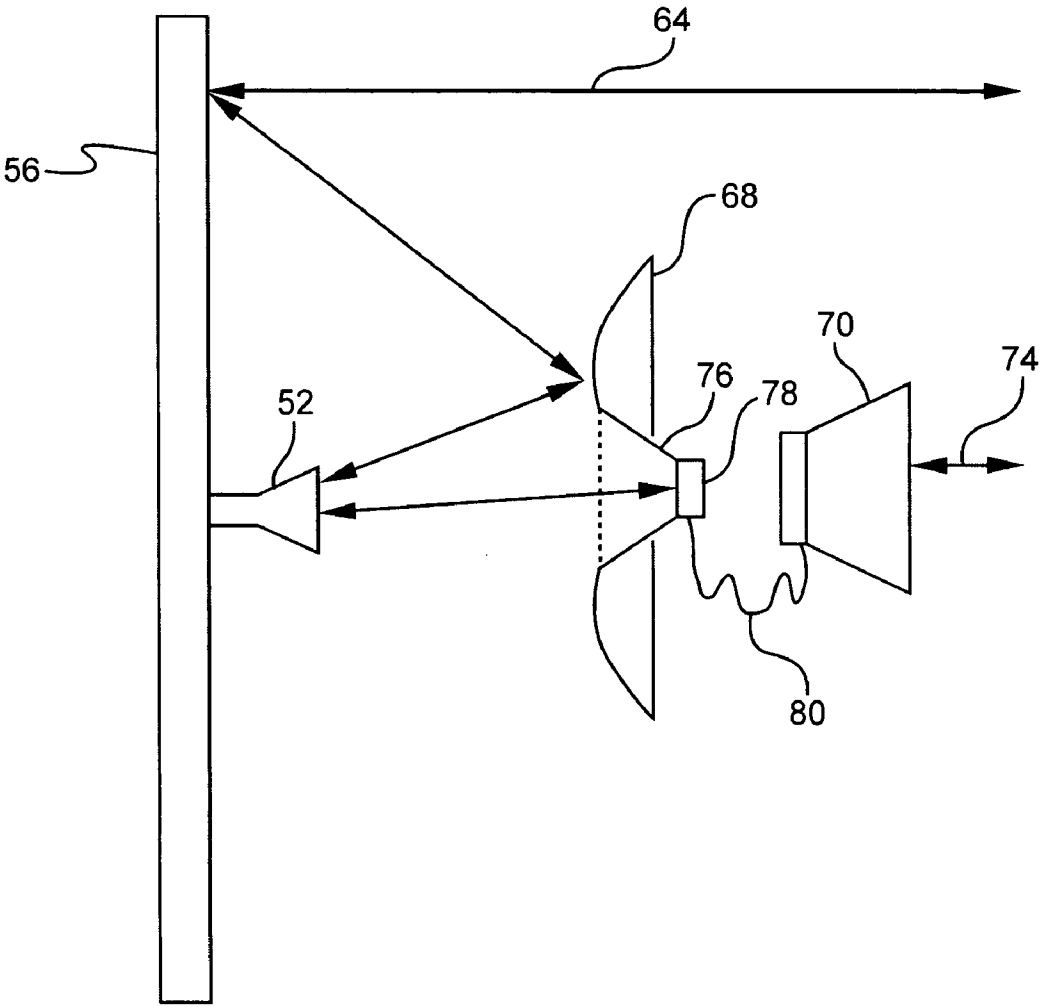
FIG. 10*b* is the second embodiment of the present invention applied to a FLAPS collector.
Figure 10C:
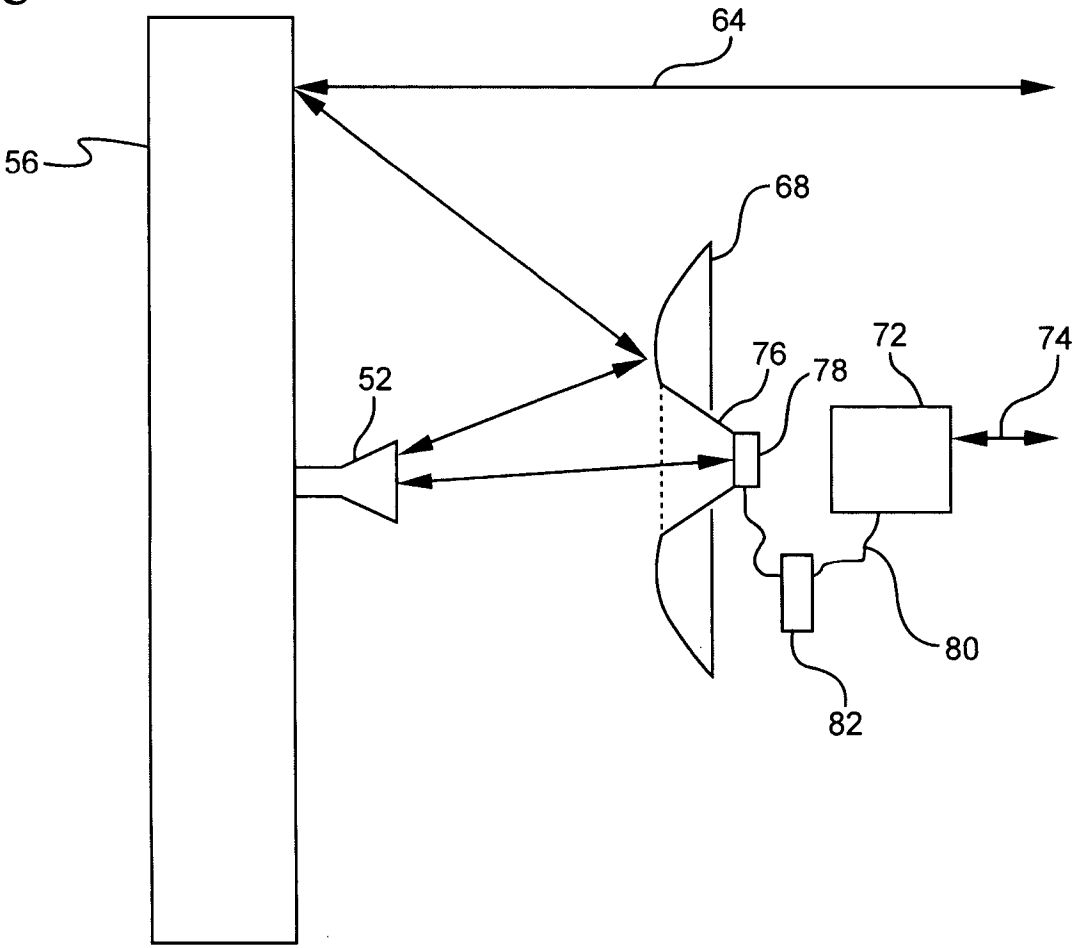
FIG. 10*c* is the second embodiment of the present invention applied to a generic collector surface.

FIG. 10*a* shows the second embodiment of the present invention applied to a parabolic collector surface 54, FIG. 10*b* shows the second applied to a FLAPS collector surface 56, and FIG. 10*c* shows the second embodiment applied to a collector surface 58 known in the art. In the second embodiment, the leaky subreflector of the first embodiment shown in FIGS. 9*a*, 9*b*, and 9*c* is preferably replaced by a solid subreflector 68. As described above, a smaller secondary shadow (not shown) is manifested in the center of the solid subreflector 68 that corresponds to the shadow on the main collector surface 54, 56, 58.

The second embodiment preferably collects energy 74 using an auxiliary antenna 70, 72 in substantially the same way shown in FIG. 8 with respect to the prime focus feed mechanism and provides this energy 74 so that it may be combined with energy 64 collected from the main reflector surface 64. Thus, the second embodiment minimizes the effects of the shadow due to feed or subreflector blockage. As described with respect to the first embodiment, the collected energy 74 may be adjusted in direction, amplitude, and phase so that it can be appropriately combined with energy 64 from the main collector surface 54, 56, 58. These adjustments are preferably performed in the second embodiment by a lens antenna or horn antenna 70 shown in FIGS. 10*a* and 10*b* or an alternative structure 72 known in the art shown in FIG. 10*c*.

In the second embodiment, a hole 76 is preferably cut in the subreflector 68 where the blockage shadow is located. The energy from the secondary antenna 70, 72 is preferably routed to a secondary feed mechanism 78 placed in the hole 76 in the subreflector 68.

Placing the secondary feed mechanism 78 where the shadow is located on the subreflector 68 substantially meets the requirements of having the signals in the proper geometrical location, but it does not account for proper phasing or amplitude between the signal injected at the secondary feed mechanism 78 and the signal from the primary feed mechanism 52.

Proper phasing between these signals is preferably accomplished by introducing an electrical delay or delay element 80, 82 between the primary feed mechanism 52 and the secondary feed mechanism 78. This electrical delay 80, 82 is preferably implemented by coupling the secondary antenna 70, 72 to the secondary feed mechanism 78 through a coaxial cable having a length in accordance with the desired delay. Direction, amplitude, and phase adjustments may also be implemented in the delay element 82 by means known in the art.

If the delay 80, 82 introduced is correct to within modulo 360°, that is, the energy 74 from the secondary antenna 70, 72 and the energy 64 from the main collector surface 54, 56, 58 differ in phase, if at all, by a multiple of $2\pi$ radians, then the second embodiment preferably exhibits a bandwidth performance that is substantially the same as that of the first embodiment. However, if the delay 80, 82 introduced corresponds to that of the path length between the main reflector shadow and the subreflector 68, and this is not modulo 360°, then the bandwidth of the second embodiment would be limited by the particular microwave components used to implement the antenna.

Figure 10D:
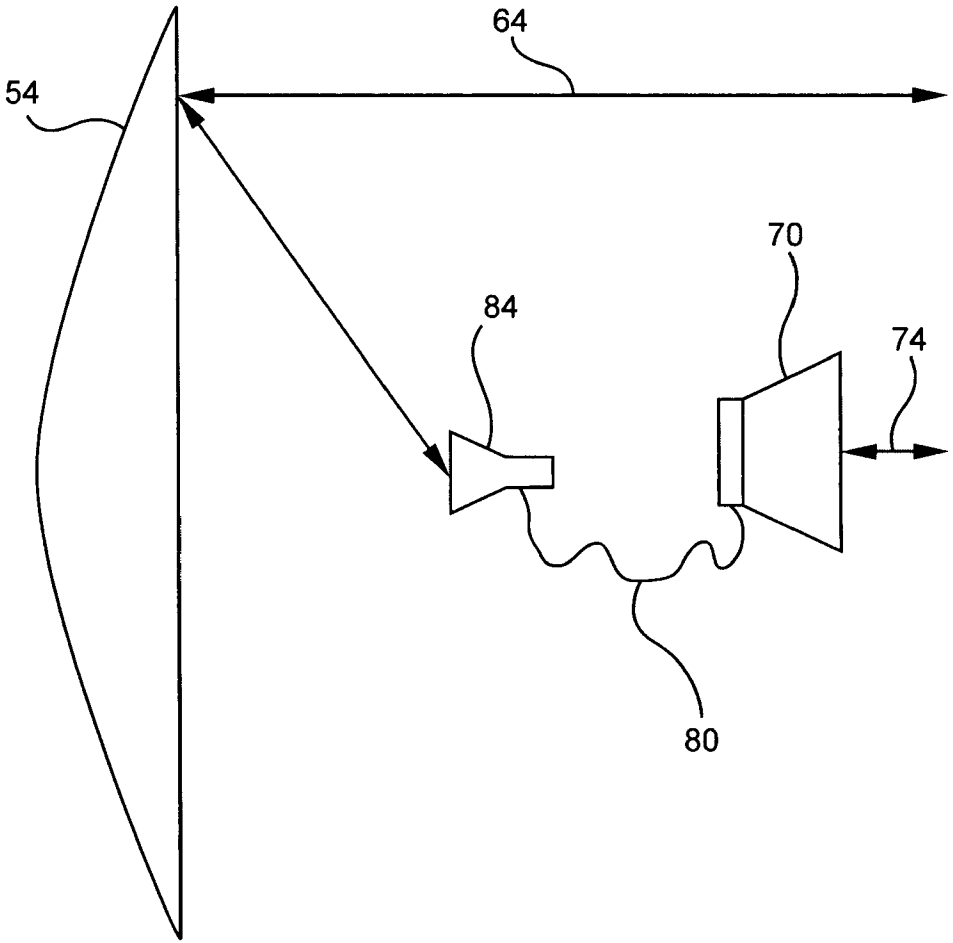
FIG. 10*d* is the second embodiment of the present invention applied to a parabolic collector surface and a prime focus feed mechanism.
Figure 10E:
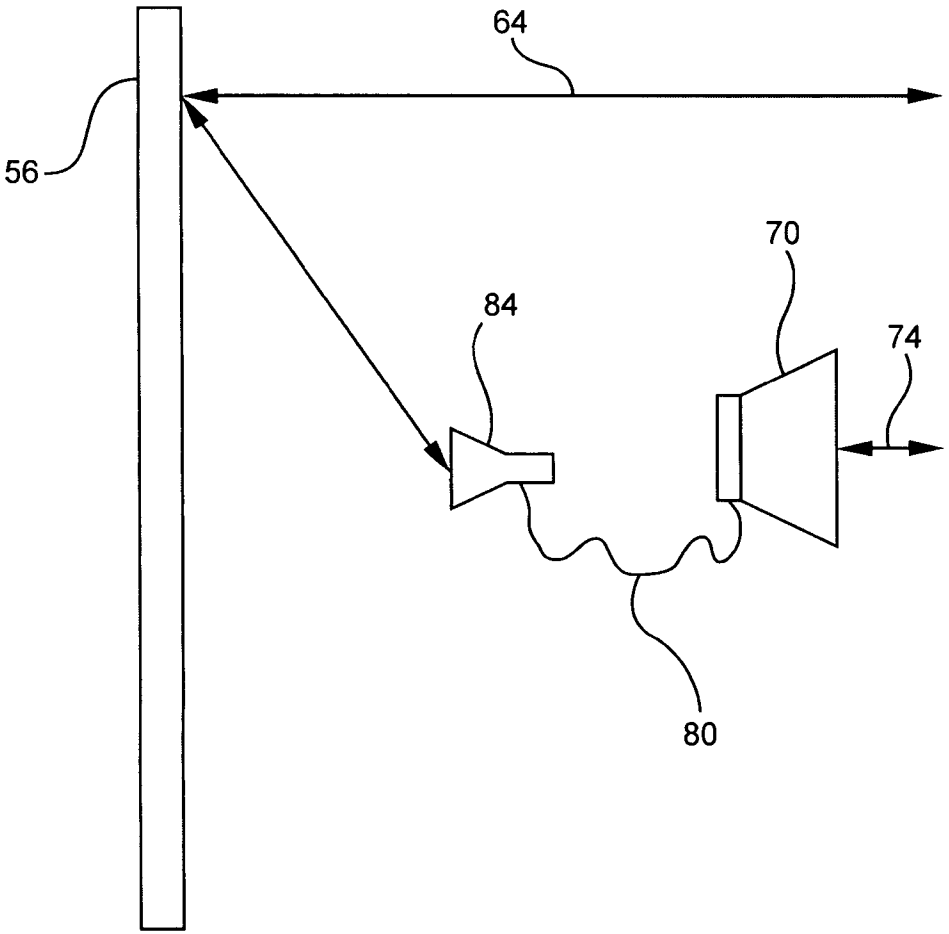
FIG. 10*e* is a second embodiment of the present invention applied to a FLAPS collector and a prime focus feed mechanism.
Figure 10F:
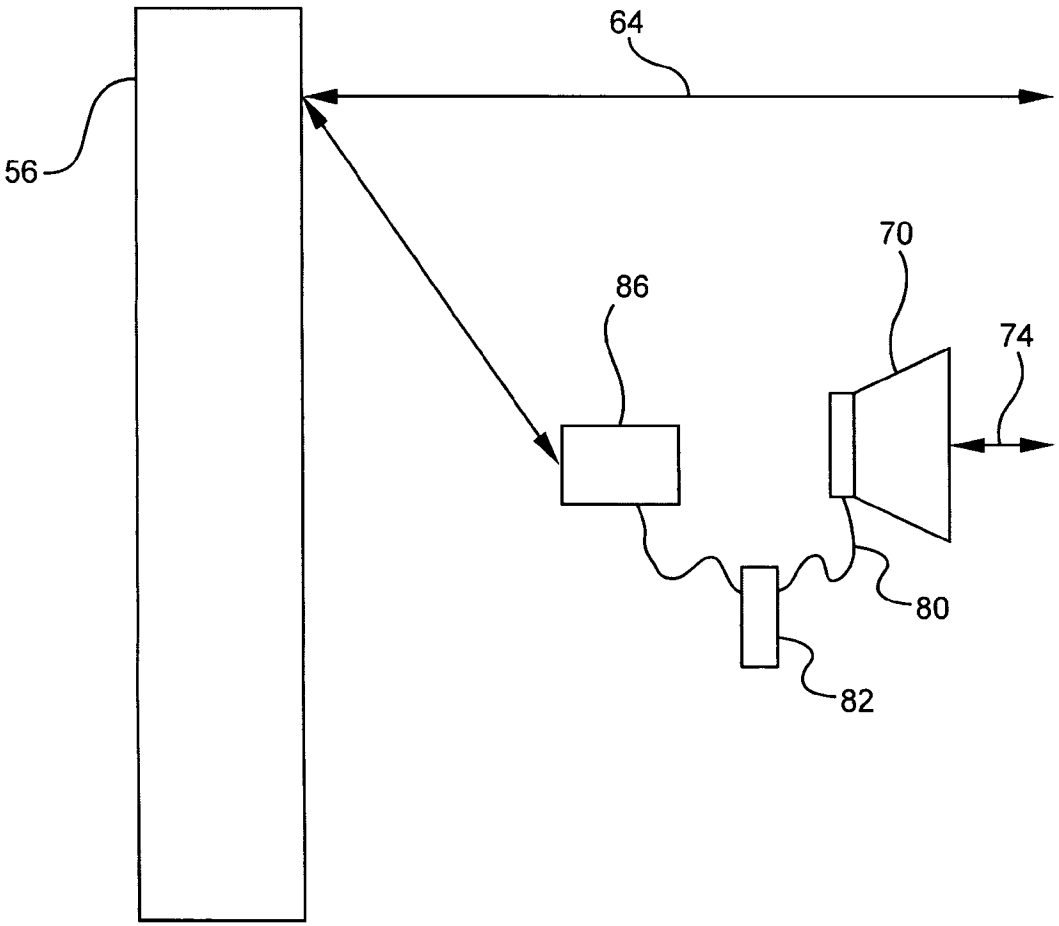
FIG. 10*f* is the second embodiment of the present invention applied to a generic collector surface and a prime focus feed mechanism.

FIGS. 10*d*, 10*e*, 10*f* provide greater detail than that shown in FIG. 8 regarding the second embodiment of the present invention applied to a reflector antenna having a prime focus feed mechanism. FIGS. 10*d*, 10*e*, and 10*f* are substantially similar and correspond FIGS. 10*a*, 10*b*, 10*c*, except that the subreflector 68 in FIGS. 10*a*, 10*b*, 10*c* has been replaced with a prime focus feed mechanism 84 or an alternative feed mechanism 86 known in the art in FIGS. 10*d*, 10*e*, and 10*f*. The feed mechanism 84, 86 is preferably operatively coupled to the secondary antenna 70, 72 through a coaxial cable or delay element 80, 82.

Figure 11:
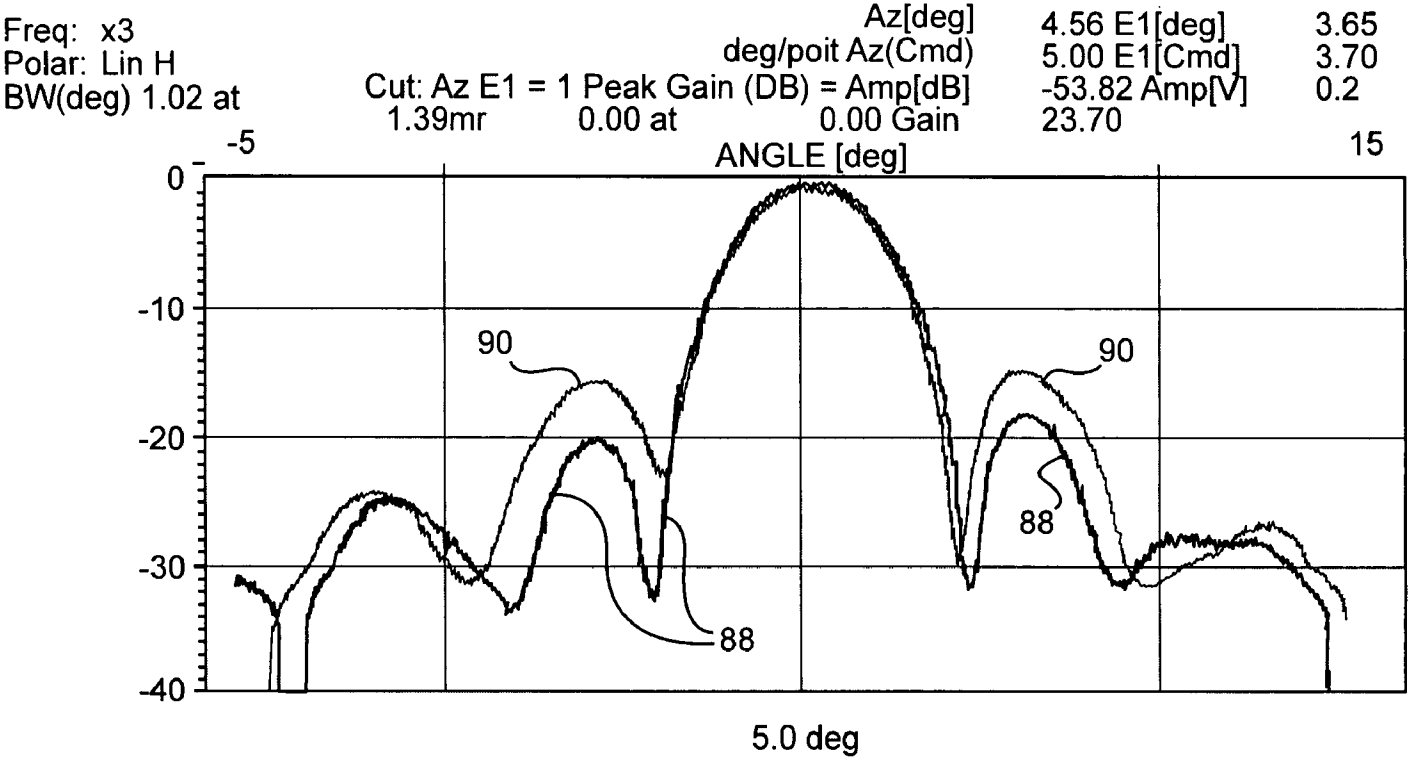
FIG. 11 is an antenna pattern obtained from an experimental implementation of the second embodiment of the present invention, such as that shown in FIGS. 10*a–c*, in comparison with an antenna pattern exhibiting blockage of the collector surface.

A solid line 84 in FIG. 11 represents an antenna pattern obtained from an experimental implementation of the second embodiment of the present invention shown in FIG. 10*b*. A dotted line 86 in FIG. 11 represents an antenna pattern exhibiting blockage by the feed mechanism. Clearly, the level of the sidelobes shown by the dotted line 86 is substantially higher than that shown by the solid line 84. Thus, in accordance with one goal, the method and apparatus formed in accordance with the present invention effectively reduce sidelobe levels.

It is to be noted that references herein to receive and/or transmit functions apply to either and/or both of these functions, which are intended to be within the scope of the present invention in accordance with the reciprocity theorem as it relates to antenna design.

Therefore, the method and apparatus formed in accordance with the present invention achieve substantially ideal performance characteristics from a reflector antenna by increasing antenna gain and efficiency, as well as reducing sidelobe levels. The method and apparatus formed in accordance with the present invention also substantially eliminate the effects of collector surface blockage by a feed mechanism or subreflector in reflector antennas.

Although illustrative embodiments of the present invention have been described herein with reference to the accompanying drawing, it is to be understood that the invention is not limited to those precise embodiments, and that various other changes and modifications may be applied therein by one skilled in the art without departing from the scope or spirit of the invention.

What is claimed is:

1. A method of reducing blockage in a reflector antenna, the method comprising:

disposing at least a portion of a feed mechanism in front of a first reflector, the feed mechanism being adapted to at least one of receive and transmit;

disposing at least a portion of a second reflector in front of the feed mechanism, at least a portion of the second reflector being adapted to permit energy to pass therethrough, the energy passing through the at least a portion of the second reflector having otherwise been blocked from being at least one of received by the first reflector and transmitted by the first reflector; and adjusting at least one of phase, amplitude, and direction of the energy passing through the at least a portion of the second reflector.

2. A method of reducing blockage in a reflector antenna as defined by claim 1, wherein disposing at least a portion of the second reflector in front of the feed mechanism further comprises disposing at least a portion of the second reflector in front of the feed mechanism in accordance with at least one of a gregorian geometry and a cassegrain geometry.

3. A method of reducing blockage in a reflector antenna as defined by claim 1, further comprising coupling a delay element operatively between the feed mechanism and the second reflector.

4. A method of reducing blockage in a reflector antenna as defined by claim 3, wherein the delay element comprises at least one of a lens antenna and a coating on the second reflector.

5. A method of reducing blockage in a reflector antenna as defined by claim 1, wherein the first reflector comprises at least one of a parabolic reflector and a Flat Parabolic Surface (FLAPS) reflector.

6. A reflector antenna, the reflector antenna comprising:

a first reflector, the first reflector being adapted to at least one of receive and transmit energy;

a feed mechanism, at least a portion of the feed mechanism being disposed in front of the first reflector, the feed mechanism being adapted to at least one of receive and transmit energy; and a second reflector, at least a portion of the second reflector being disposed in front of the feed mechanism, at least a portion of the second reflector being adapted to permit energy to pass therethrough, the energy passing through the at least a portion of the second reflector having otherwise been blocked from being at least one of received by the first reflector and transmitted by the first reflector, the energy passing through the at least a portion of the second reflector being adjusted in at least one of phase, amplitude, and direction.

7. A reflector antenna as defined by claim 6, wherein at least a portion of the second reflector is disposed in front of the feed mechanism in accordance with at least one of a gregorian geometry and a cassegrain geometry.

8. A reflector antenna as defined by claim 6, further comprising a delay element, the delay element being operatively coupled between the feed mechanism and the second reflector.

9. A reflector antenna as defined by claim 8, wherein the delay element comprises at least one of lens antenna and a coating on the second reflector.

10. A reflector antenna as defined by claim 6, wherein the first reflector comprises at least one of a parabolic reflector and a Flat Parabolic Surface (FLAPS) reflector.

11. A method of reducing blockage in a reflector antenna, the method comprising:

disposing at least a portion of a first feed mechanism in front of a first reflector, at least a portion of the first feed mechanism blocking energy from being at least one of received by the first reflector and transmitted by the first reflector, the first feed mechanism being adapted to at least one of receive and transmit;

disposing at least a portion of a second antenna in front of the first feed mechanism, the second antenna being adapted to at least one of receive and transmit at least a portion of the energy blocked by the first feed mechanism; and adjusting at least one of phase, amplitude, and direction of at least a portion of the energy to be at least one of received and transmitted by the second antenna.

12. A method of reducing blockage in a reflector antenna as defined by claim 11, further comprising coupling the second antenna operatively to the first feed mechanism.

13. A method of reducing blockage in a reflector antenna as defined by claim 11, further comprising coupling a delay element operatively between the first feed mechanism and the second antenna.

14. A method of reducing blockage in a reflector antenna as defined by claim 11, further comprising:

selecting a coaxial cable comprising a length in accordance with a desired delay; and coupling the second antenna operatively to the first feed mechanism through the coaxial cable.

15. A method of reducing blockage in a reflector antenna as defined by claim 11, wherein disposing at least a portion of the first feed mechanism in front of the first reflector comprises disposing at least a portion of a prime focus feed mechanism in front of the first reflector.

16. A method of reducing blockage in a reflector antenna as defined by claim 11, further comprising:

disposing at least a portion of a second reflector between the first feed mechanism and the second antenna, the second reflector including a hole;

disposing at least a portion of a second feed mechanism in the hole of the second reflector, the second feed mechanism being adapted to at least one of receive and transmit; and coupling the second antenna operatively to the second feed mechanism.

17. A method of reducing blockage in a reflector antenna as defined by claim 16, wherein disposing at least a portion of the second reflector in front of the first feed mechanism further comprises disposing at least a portion of the second reflector in front of the first feed mechanism in accordance with at least one of a gregorian geometry and a cassegrain geometry.

18. A method of reducing blockage in a reflector antenna as defined by claim 16, wherein coupling the second antenna to the second feed mechanism comprises coupling the second antenna to the second feed mechanism through a delay element.

19. A method of reducing blockage in a reflector antenna as defined by claim 18, wherein coupling the second antenna to the second feed mechanism further comprises:

selecting a coaxial cable comprising a length in accordance with a desired delay; and coupling the coaxial cable operatively between the second antenna and the second feed mechanism.

20. A method of reducing blockage in a reflector antenna as defined by claim 16, further comprising disposing the hole in a center of the second reflector.

21. A method of reducing blockage in a reflector antenna as defined by claim 11, wherein the first reflector comprises at least one of a parabolic reflector and a Flat Parabolic Surface (FLAPS) reflector.

22. A method of reducing blockage in a reflector antenna as defined by claim 11, wherein the second antenna comprises at least one of a horn antenna and a lens antenna.

23. A reflector antenna, the reflector antenna comprising:

a first reflector, the first reflector being adapted to at least one of receive and transmit energy;

a first feed mechanism, at least a portion of the first feed mechanism being disposed in front of the first reflector, at least a portion of the first feed mechanism blocking energy from being at least one of received by the first reflector and transmitted by the first reflector, the first feed mechanism being adapted to at least one of receive and transmit; and a second antenna, at least a portion of the second antenna being disposed in front of the first feed mechanism, the second antenna being adapted to at least one of receive and transmit at least a portion of the energy blocked by the first feed mechanism, at least one of phase, amplitude, and direction of at least a portion of the energy that is at least one of received by the second antenna and transmitted by the second antenna being adjusted.

24. A reflector antenna as defined by claim 23, wherein the second antenna is operatively coupled to the first feed mechanism.

25. A reflector antenna as defined by claim 23, further comprising a delay element, the delay element being operatively coupled between the first feed mechanism and the second antenna.

26. A reflector antenna as defined by claim 25 wherein the delay element comprises a coaxial cable, the coaxial cable including a length, the length being chosen in accordance with a desired delay.

27. A reflector antenna as defined by claim 23, wherein the first feed mechanism comprises a prime focus feed mechanism.

28. A reflector antenna as defined by claim 23, further comprising:

a second reflector, at least a portion of the second reflector being disposed between the first feed mechanism and the second antenna, the second reflector including a hole; and a second feed mechanism, at least a portion of the second feed mechanism being disposed in the hole of the second reflector, the second feed mechanism being adapted to at least one of receive and transmit, the second antenna being operatively coupled to the second feed mechanism.

29. A reflector antenna as defined by claim 28, wherein at least a portion of the second reflector is disposed in front of the first feed mechanism in accordance with at least one of a gregorian geometry and a cassegrain geometry.

30. A reflector antenna as defined by claim 28, further comprising a delay element, the delay element being operatively coupled between the second antenna and the second feed mechanism.

31. A reflector antenna as defined by claim 30, wherein the delay element comprises a coaxial cable, the coaxial cable including a length, the length being chosen in accordance with a desired delay.

32. A reflector antenna as defined by claim 28, wherein the hole is located in a center of the second reflector.

33. A reflector antenna as defined by claim 23, wherein the first reflector comprises at least one of a parabolic reflector and a Flat Parabolic Surface (FLAPS) reflector.

34. A reflector antenna as defined by claim 23, wherein the second antenna comprises at least one of a horn antenna and a lens antenna.

* * * * *